US009044944B2

(12) United States Patent
Omura et al.

(10) Patent No.: US 9,044,944 B2
(45) Date of Patent: Jun. 2, 2015

(54) LIQUID DISCHARGE HEAD AND METHOD OF MAKING THE SAME

(71) Applicant: CANON KABUSHIKI KAISHA, Tokyo (JP)

(72) Inventors: Atsushi Omura, Kawasaki (JP); Shuichi Murakami, Kawasaki (JP); Toshikazu Nagatsuka, Tokyo (JP); Keiji Tomizawa, Yokohama (JP); Etsuko Sawada, Tokyo (JP); Hiroaki Mihara, Machida (JP); Yohei Hamade, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/252,594

(22) Filed: Apr. 14, 2014

(65) Prior Publication Data

US 2014/0307028 A1 Oct. 16, 2014

(30) Foreign Application Priority Data

Apr. 16, 2013 (JP) ..... 2013-085692

(51) Int. Cl.
*B41J 2/135* (2006.01)
*B41J 2/14* (2006.01)
*B41J 2/16* (2006.01)

(52) U.S. Cl.
CPC ..... *B41J 2/1433* (2013.01); *B41J 2/1603* (2013.01); *B41J 2/1606* (2013.01); *B41J 2/1631* (2013.01); *B41J 2/1645* (2013.01); *B41J 2002/14387* (2013.01)

(58) Field of Classification Search
None
See application file for complete search history.

(56) References Cited

U.S. PATENT DOCUMENTS

2010/0079542 A1* 4/2010 Ciminelli et al. ..... 347/40
2013/0027469 A1* 1/2013 Ishikawa et al. ..... 347/44

FOREIGN PATENT DOCUMENTS

JP 8-118656 A 5/1996
JP 10-157150 A 6/1998
JP 2001-105599 A 4/2001

* cited by examiner

*Primary Examiner* — Lisa M Solomon
(74) *Attorney, Agent, or Firm* — Canon USA Inc. IP Division

(57) ABSTRACT

A liquid discharge head includes a substrate including an energy generating element that generates energy used to discharge liquid and a discharge port member having a discharge port surface with a discharge port line including discharge ports, through which the liquid is discharged, arrayed in a first direction. The discharge port surface includes a groove portion disposed between the discharge port line and a first end of the discharge port member in a second direction intersecting the first direction. The groove portion extends along the discharge port line. The discharge port surface further includes an inclined surface disposed between an end of the discharge port line and a second end of the discharge port member in the first direction. The inclined surface is inclined toward the second end.

3 Claims, 8 Drawing Sheets

LIQUID DISCHARGE HEAD AND METHOD OF MAKING THE SAME

BACKGROUND OF THE INVENTION

1. Field of the Invention

The present invention relates to a liquid discharge head that discharges droplets of ink or the like for recording on a recording medium and a method of making the liquid discharge head.

2. Description of the Related Art

Inkjet type printers (inkjet printers) are used to form an image by discharging liquid, such as ink, from a liquid discharge head onto a recording medium. The inkjet printers have various advantages, e.g., easier high-definition image formation, higher speed recording, better quietness, and lower price than other types of printer.

Such inkjet printers each include a liquid discharge head that has a plurality of discharge ports, through which ink is discharged, arrayed in a discharge port surface of the head. Many of the discharge port surfaces are subjected to water-repellent treatment. The water-repellent treatment performed on the discharge port surface prevents uneven deposition of ink around the discharge ports. This reduces unintended directional discharge of ink drawn to deposited ink around the discharge ports when ink is discharged.

Instead of the water-repellent treatment, hydrophilic treatment may be performed in the use of an ink that interferes with the effectiveness of water-repellent treatment on the discharge port surface, for example, pigment ink or high-function ink, or in the use of small-diameter discharge ports which tend to increase the viscosity of ink in the discharge ports. Japanese Patent Laid-Open Nos. 8-118656 and 2001-105599 each disclose a liquid discharge head having a discharge port surface subjected to hydrophilic treatment.

The hydrophilic treatment allows a thin layer of ink absorbed by a hydrophilic treatment layer to be formed on the entire discharge port surface, causing little or no difference in wettability between this thin layer and ink deposited around the discharge ports. This allows ink to be easily discharged in an intended direction. Furthermore, the thin layer of ink on the discharge port surface protects ink in the small-diameter discharge ports against drying. This eliminates auxiliary discharge that is needed to discharge high-viscosity ink from a liquid discharge head having a discharge port surface subjected to water-repellent treatment. In addition, since a thin ink layer is formed on the entire discharge port surface during discharge of ink, high ink discharge performance can be stably maintained.

An uneven central region where the discharge ports are arrayed in the discharge port surface of the liquid discharge head leads to nonuniformity in the distance between each discharge port and an energy generating element (ink discharge energy generating element substrate) that causes film boiling of ink. This results in nonuniformity in the volume of ink stored between the discharge port and the energy generating element, thus leading to nonuniformity in the volume of ink to be discharged. Japanese Patent Laid-Open No. 10-157150 discloses a liquid discharge head which has a groove surrounding a plurality of discharge ports like those illustrated in FIG. 9A to provide an even central region, where the discharge ports are arrayed, of a discharge port surface. As regards a liquid discharge head having no groove, resin constituting a resin coating layer spreads out from an applied position by the gravity before the resin coating layer applied on a substrate is cured, resulting in an uneven discharge port surface. In the liquid discharge head disclosed in Japanese Patent Laid-Open No. 10-157150, resin constituting a resin coating layer is applied to an area including a pattern (base pattern) for the groove disposed in the discharge port surface. The pattern for the groove can prevent the resin constituting the resin coating layer from spreading out. This allows a central region of the discharge port surface where the discharge ports are arrayed, specifically, the region inside the groove to become even.

Inkjet printers have recently offered higher image quality and higher speed recording. Achieving these advantages requires smaller droplets of ink discharged and a reduction in ink discharge interval (discharge frequency). In a liquid discharge head which discharges such small droplets at high speed, an increased refill speed, at which a discharge port is refilled with ink, may increase meniscus vibration, thus causing ink to flow over meniscus formed in the discharge port from the discharge port onto a discharge port surface. If the discharge port surface is provided with a hydrophilic treatment layer, the ink which has overflowed onto the discharge port surface is absorbed by the hydrophilic treatment layer, thus forming a thin layer of ink.

In a liquid discharge head having a discharge port array density of 600 dpi or more and an ink discharge frequency of 10 kHz or more, the volume of ink overflowing from discharge ports onto a discharge port surface is too much. Unfortunately, the ink cannot be completely absorbed by a hydrophilic treatment layer. In the liquid discharge head disclosed in Japanese Patent Laid-Open No. 8-118656 or 2001-105599, if ink which has overflowed from the discharge ports onto the discharge port surface is not completely absorbed by the hydrophilic treatment layer, the discharge ports may be blocked by the ink which has not been absorbed. This may inhibit ink from being discharged from the discharge ports.

The liquid discharge head disclosed in Japanese Patent Laid-Open No. 10-157150 has a phenomenon (pinning effect) in which right-angled edges of the groove disposed in the discharge port surface prevent ink from traveling, so that ink does not flow into the groove. A large volume of ink accordingly tends to accumulate due to overflow in the central region surrounded by the groove. Unfortunately, the discharge ports tend to be blocked by ink which has not been absorbed, so that ink may fail to be discharged from the discharge ports.

SUMMARY OF THE INVENTION

The present invention provides a liquid discharge head including a substrate including an energy generating element that generates energy used to discharge liquid and a discharge port member having a discharge port surface with a discharge port line including discharge ports, through which the liquid is discharged, arrayed in a first direction. The discharge port surface includes a groove portion disposed between the discharge port line and a first end of the discharge port member in a second direction intersecting the first direction. The groove portion extends along the discharge port line. The discharge port surface further includes an inclined surface disposed between an end of the discharge port line and a second end of the discharge port member in the first direction. The inclined surface is inclined toward the second end.

The present invention further provides a method of making a liquid discharge head, the method including the steps of (a) preparing a substrate including a plurality of energy generating elements arranged in lines in a surface of the substrate, (b) forming a soluble resin layer on the surface of the substrate using soluble resin, the soluble resin layer including ink passage patterns and groove patterns, the ink passage patterns overlying the energy generating elements, (c) forming a resin coating layer so as to cover the soluble resin layer with the resin coating layer, (d) forming a plurality of discharge ports on the ink passage patterns and forming a plurality of through holes on the groove patterns by exposing and developing the resin coating layer, (e) performing hydrophilic treatment on a discharge port surface of the resin coating layer in which the discharge ports are arrayed, and (f) forming ink passages and grooves by dissolving and removing the soluble resin layer. The step (c) includes forming inclined surfaces such that each inclined surface is disposed between an end of the resin coating layer intersecting extension lines of discharge port lines defined by the discharge ports and ends of the discharge port lines.

Further features of the present invention will become apparent from the following description of exemplary embodiments with reference to the attached drawings.

DESCRIPTION OF THE EMBODIMENTS

Embodiments of the present invention will be described below with reference to the drawings.

Figure 1A:
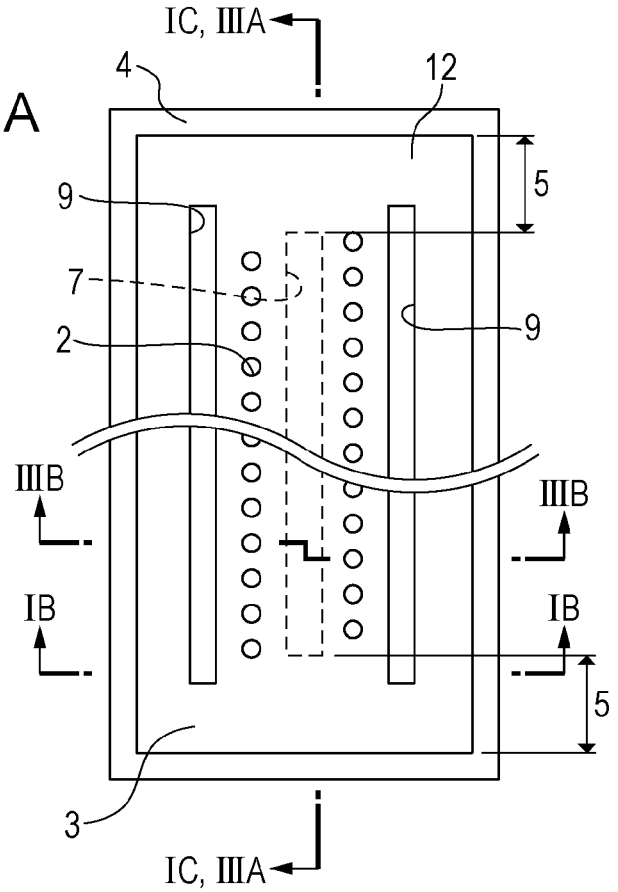
FIGS. 1A to 1C illustrate a liquid discharge head according to a first embodiment of the present invention.
Figure 1B:
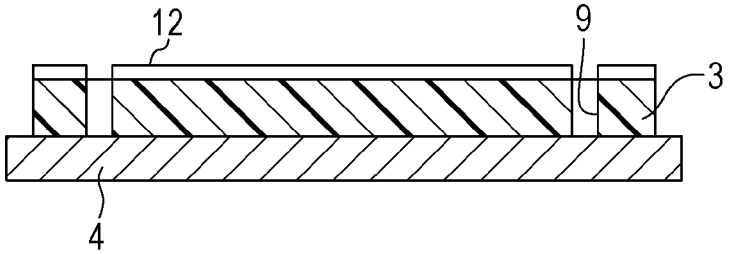
Figure 1C:
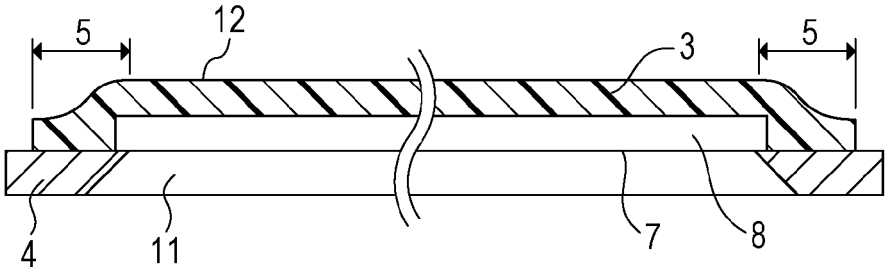
Figure 2:
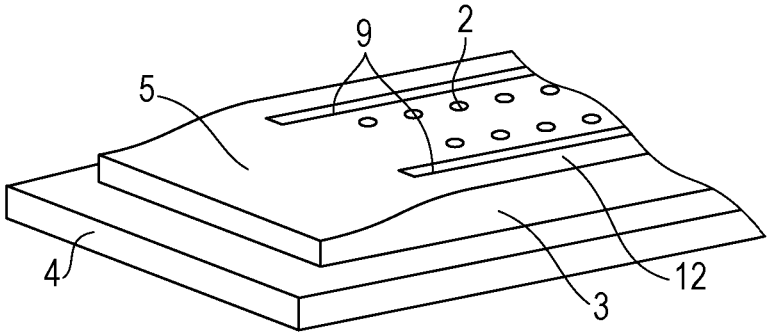
FIG. 2 is a perspective view illustrating a slope region of the liquid discharge head of FIGS. 1A to 1C.

FIG. 1A is a plan view of a liquid discharge head according to a first embodiment of the present invention. FIG. 1B is a cross-sectional view of the liquid discharge head taken along the line IB-IB in FIG. 1A. FIG. 1C is a longitudinal sectional view thereof taken along the line IC-IC in FIG. 1A. FIG. 2 is a perspective view illustrating a slope region of the liquid discharge head according to the first embodiment.

The liquid discharge head has a rectangular shape having long sides and short sides. The liquid discharge head includes a substrate 4 and a resin coating layer 3 disposed on the substrate 4. The substrate 4 includes a plurality of energy generating elements 1, which will be described later, and has an ink supply port 7 and a common liquid chamber 11. The resin coating layer 3, serving as a discharge port member, has a discharge port surface 12 in which a plurality of discharge ports 2 for discharging ink are arrayed.

The substrate 4 has the common liquid chamber 11 to which ink is supplied from an ink tank (not illustrated) and the ink supply port 7 for supplying ink from the common liquid chamber 11 to ink passages 8 arranged in the resin coating layer 3. The energy generating elements 1 (refer to FIG. 3B) that generate thermal energy used to discharge ink are arrayed in lines near the ink supply port 7 in the surface of the substrate 4 such that the ink supply port 7 is sandwiched between two lines of the energy generating elements 1. In the first embodiment, the energy generating element 1 is an electrothermal transducing element. The present invention is not limited to this example and any other energy generating element, such as a piezoelectric transducer, may be used.

The discharge port surface 12, serving as a main surface, of the resin coating layer 3 is subjected to hydrophilic surface treatment. In the discharge port surface 12, the discharge ports 2 are arrayed in lines extending directly above the energy generating elements 1 arranged in the substrate 4, thus defining a pair of discharge port lines so as to sandwich the ink supply port 7 between the discharge port lines. The term "hydrophilic" used herein means that the static contact angle of pure water on the discharge port surface is less than or equal to 30°. The present invention includes the case where hydrophilic treatment is performed on the discharge port surface after formation of the resin coating layer and also includes a case where the discharge port surface is allowed to have a hydrophilic property by forming the surface using a hydrophilic resin material. The discharge ports 2 are arrayed at a high density of 600 dpi or more. The resin coating layer 3 is formed of photosensitive resin and has a pair of linear grooves 9 (groove portions) extending along the discharge port lines and the ink passages 8 into which ink flows from the ink supply port 7. The pair of grooves 9 are arranged so as to sandwich the ink supply port 7 in the substrate 4 and the pair of discharge port lines. As illustrated in FIG. 1B, the grooves 9 extend from the discharge port surface 12 to the interface between the substrate 4 and the resin coating layer 3 and are independent of each other, or do not communicate with each other. The grooves 9 are arranged so as not to reach regions that are sandwiched between extension lines of the discharge port lines and each region is disposed between an end of the resin coating layer 3 intersecting the extension lines of the discharge port lines and ends of the discharge port lines. The ink passages 8 communicate with the respective discharge ports 2 and the ink supply port 7 so as to feed ink supplied from the ink supply port 7 to the respective discharge ports 2. In each ink passage 8, a region sandwiched between the discharge ports 2 and the energy generating elements 1 is defined as an energy acting chamber 13.

As illustrated in FIG. 2, the discharge port surface 12 of the resin coating layer 3 includes slope regions 5 (inclined surfaces). Each slope region 5 is continuous between the end of the resin coating layer 3 intersecting the extension lines of the discharge port lines and the ends of the discharge port lines. As illustrated in FIG. 1C, the slope region 5 is shaped so as to continuously decrease in height from an end of the ink supply port 7 to the end of the resin coating layer 3.

A method of discharging ink using the liquid discharge head with the above-described configuration will be described below.

Ink previously supplied from the ink tank (not illustrated) to the liquid discharge head flows into the common liquid chamber 11 of the liquid discharge head, passes through the ink supply port 7, and flows into the ink passages 8 including the energy acting chambers 13 and the discharge ports 2, thus forming meniscus in each of the discharge ports 2.

When a printer including the liquid discharge head according to the first embodiment receives image data for an image to be formed on a recording medium, an electrical signal is transmitted to the energy generating elements 1 arranged directly below the discharge ports 2 in accordance with the image data, so that the energy generating elements 1 generate heat in response to the electrical signal. The heat generated by the energy generating elements 1 transfers thermal energy to the ink in the energy acting chambers 13, so that the ink in the vicinity of the energy generating elements 1 is instantaneously heated and thus boils (film boiling), so that bubbles are formed on the surfaces of the energy generating elements 1. The bubbling pressure of the bubbles applies kinetic energy to the ink in the energy acting chambers 13, so that the ink is discharged out of the liquid discharge head through the discharge ports 2. Upon discharge of the ink in the energy acting chambers 13, ink flows from the common liquid chamber 11 through the ink passages 8 into the energy acting chambers 13 such that the energy acting chambers 13 are refilled with ink. The next electrical signal is transmitted to the energy generating elements 1, bubbles are generated, and ink is discharged through the discharge ports 2. The liquid discharge head discharges ink by repeating such a cycle. The liquid discharge head according to the first embodiment is configured such that the head is driven at a high discharge frequency of 10 kHz or more for high-speed recording and the discharge volume of ink per discharge from each discharge port 2 is 5 pl or less for high-definition image formation.

Figure 4:
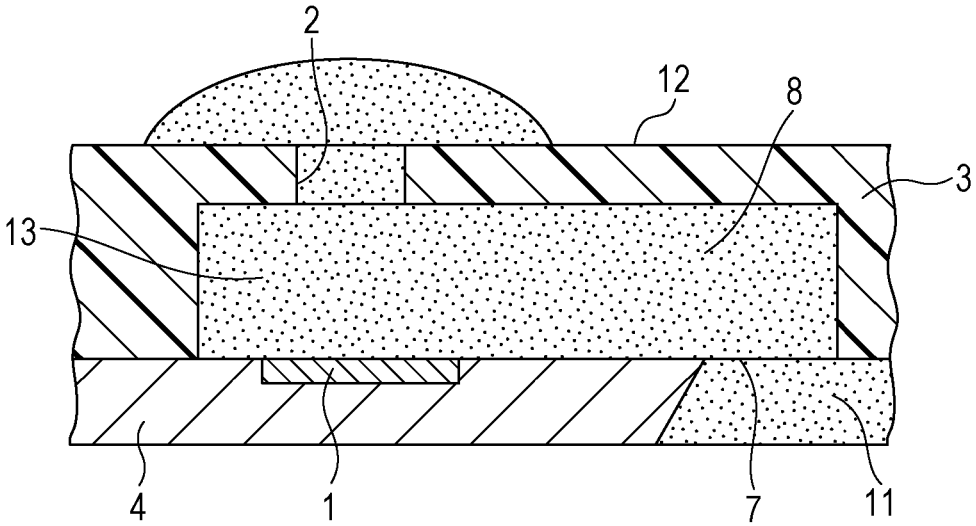
FIG. 4 is a sectional view illustrating a state just after ink has overflowed onto the discharge port surface of the liquid discharge head.

As ink is discharged at higher discharge frequency, the refill speed at which the energy acting chamber 13 is refilled with ink upon discharge increases. The increase of the refill speed causes the energy acting chamber 13 to be refilled with ink supplied through the ink supply port 7 more quickly than the retraction of meniscus to the ink passage 8, so that ink flows over the meniscus in each discharge port 2 onto the central region of the discharge port surface 12 as illustrated in FIG. 4. The ink which has overflowed in the central region of the discharge port surface 12 is absorbed by the hydrophilic treatment layer on the discharge port surface 12, thus forming a thin ink layer 10*a* in the central region of the discharge port surface 12. In this case, the ink which has overflowed in the central region of the discharge port surface 12 does not tend to flow into the grooves 9 because of the pinning effect in which ink is inhibited from further traveling by the right-angled edges of the grooves 9 arranged in the discharge port surface 12. Consequently, the ink spreads out along the grooves 9. The thin ink layer 10*a* is accordingly formed in the central region, where the discharge ports 2 are arrayed, between the pair of grooves 9 in the discharge port surface 12.

Figure 5A:
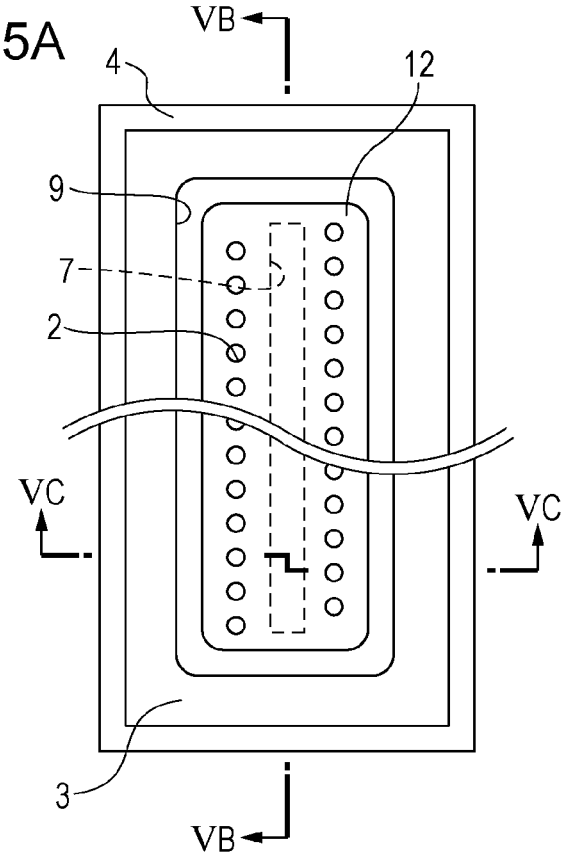
FIGS. 5A to 5C illustrate a liquid discharge head according to a comparative example.
Figure 5B:
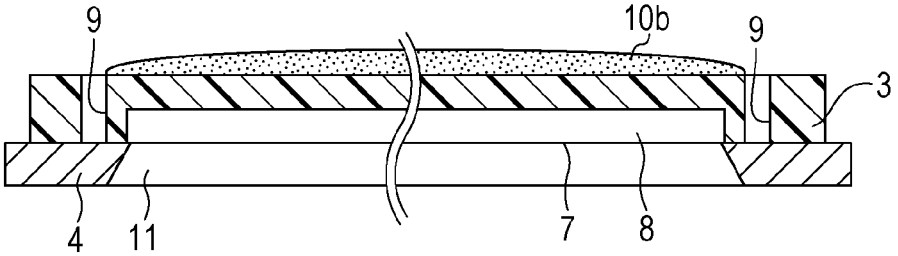
Figure 5C:
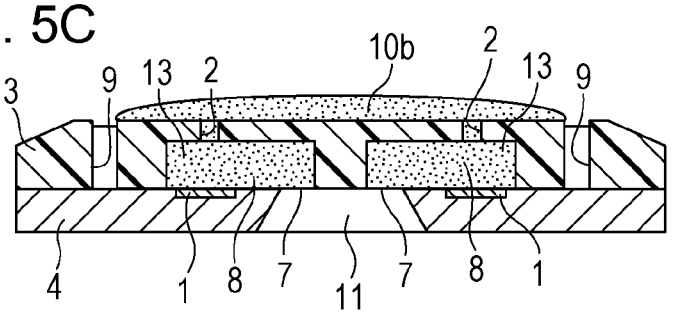

FIG. 5A is a plan view of a liquid discharge head according to a comparative example. FIG. 5B is a longitudinal sectional view of this liquid discharge head taken along the line VB-VB in FIG. 5A and illustrates a state in which a thin ink layer is formed on a discharge port surface in the comparative example. FIG. 5C is a cross-sectional view thereof taken along the line VC-VC in FIG. 5A and illustrates discharge ports in the state of FIG. 5B.

In the liquid discharge head configured such that a groove 9 surrounds a central region, where discharge ports 2 are arrayed, of a discharge port surface 12 as illustrated in FIG. 5A, repeated ink discharge at a high discharge frequency causes an overflow of ink to accumulate on the discharge port surface 12 surrounded by the groove 9. As the volume of ink overflowing onto the discharge port surface 12 increases, a hydrophilic treatment layer fails to fully absorb the ink overflowing on the discharge port surface 12, so that the ink overflowing on the discharge port surface 12 forms a thick ink layer 10*b* on the discharge port surface 12 inside the groove 9. Since the thick ink layer 10*b* is formed such that all of the discharge ports 2 are covered with the thick ink layer 10*b*, the thick ink layer 10*b* interferes with ink discharged from the discharge ports 2, thus causing defective discharge.

Figure 3A:
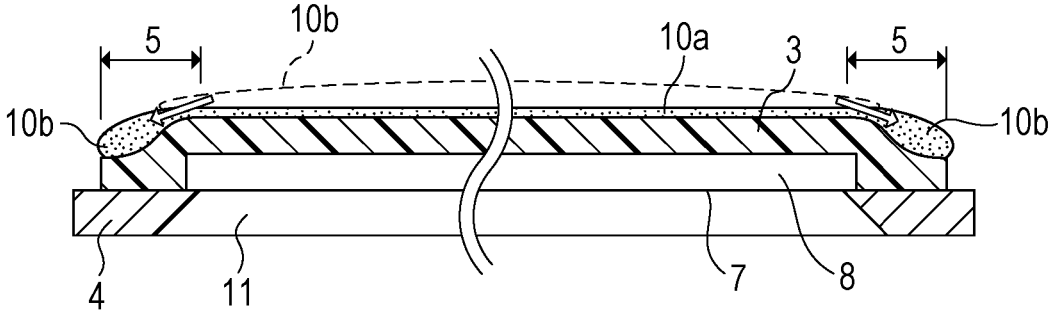
FIGS. 3A and 3B illustrate a state in which a thin ink layer is formed on a discharge port surface.
Figure 3B:
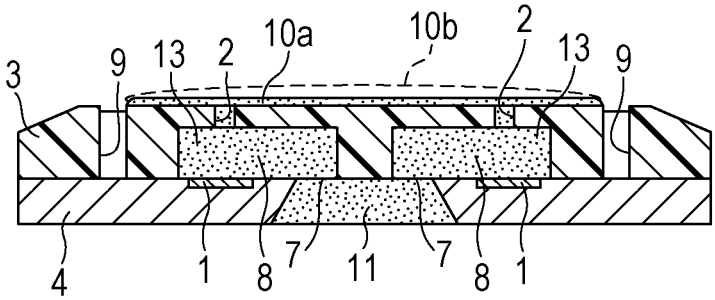

On the other hand, in the liquid discharge head according to the first embodiment, the grooves 9 are arranged so as not to continuously extend along all of the ends of the discharge port surface 12. The discharge port surface 12 includes portions where no grooves 9 are arranged. If the hydrophilic treatment layer fails to fully absorb ink overflowing on the discharge port surface 12, ink which has not been absorbed would flow to the portions where no grooves 9 are arranged. FIG. 3A is a longitudinal sectional view of the liquid discharge head taken along the line IIIA-IIIA in FIG. 1A and illustrates a state in which the thin ink layer 10*a* is formed on the discharge port surface 12. FIG. 3B is a cross-sectional view thereof taken along the line IIIB-IIIB in FIG. 1A and illustrates the state in which the thin ink layer 10*a* is formed on the discharge port surface 12. As illustrated in FIG. 3A, since the portions where no grooves 9 are arranged correspond to the slope regions 5, ink which has not been absorbed travels on the slope regions 5 toward portions where no discharge ports 2 are arrayed near the ends of the resin coating layer 3. Since the ink which has not been absorbed by the hydrophilic treatment layer travels to the portions where no discharge ports 2 are arrayed near the ends of the resin coating layer 3 as described above, a thick ink layer 10*b* is not formed in the central region, where the discharge ports 2 are arrayed, of the discharge port surface 12 as illustrated in FIG. 3B. Since the thin ink layer 10*a* is formed in the central region of the discharge port surface 12 where the discharge ports 2 are arrayed, ink is accurately discharged from the discharge ports 2 if the discharge of ink at a high discharge frequency is repeated.

As described above, the slope regions 5 of the liquid discharge head facilitate travel of an overflow of ink which is not absorbed by the hydrophilic treatment layer on the discharge port surface 12 to the portions where no discharge ports 2 are arrayed near the ends of the resin coating layer 3. Additionally, since the discharge port surface 12 includes the portions where no grooves 9 are arranged, the ink overflowing on the discharge port surface 12 is guided by the grooves 9 and is allowed to travel toward the slope regions 5. As described above, ink travels to the portions, where no discharge ports 2 are arrayed, near the ends of the resin coating layer 3, so that ink does not tend to accumulate in the central region of the discharge port surface 12 where the discharge ports 2 are arrayed, thus preventing a thick ink layer from being formed so as to block the discharge ports 2. Consequently, a predetermined volume of ink is discharged from each discharge port 2 in a given direction, leading to less or no defective discharge.

A method of making the liquid discharge head with the above-described configuration will be described below with reference to FIGS. 8A to 8E and FIGS. 9A to 9E. FIGS. 8A to 8E are cross-sectional views for illustrating the method of making the liquid discharge head taken along the line IIIB-IIIB in FIG. 1A. FIGS. 9A to 9E are plan views for illustrating the method of making the liquid discharge head and correspond to FIGS. 8A to 8E, respectively.

Figure 8A:
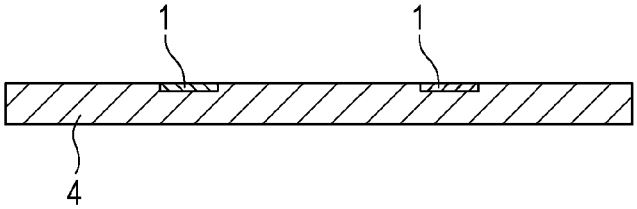
FIGS. 8A to 8E are cross-sectional views illustrating a method of making the liquid discharge head according to the first embodiment.
Figure 9A:
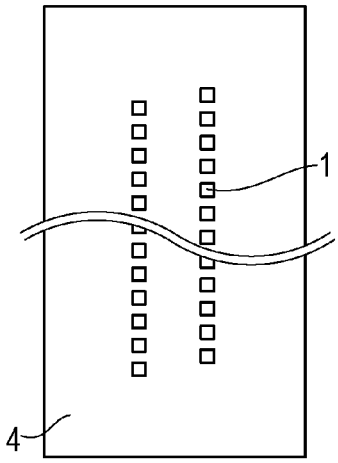
FIGS. 9A to 9E are plan views illustrating the method of making the liquid discharge head according to the first embodiment.

First, the substrate 4 including the energy generating elements 1 arranged in its surface is prepared as illustrated in FIGS. 8A and 9A. The energy generating elements 1 are arranged in a pair of lines in the central region of the substrate 4.

Figure 8B:
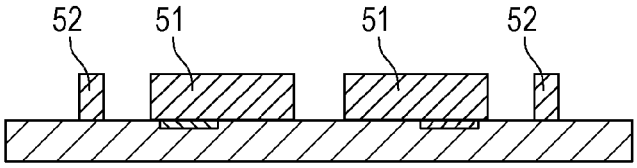
Figure 9D:
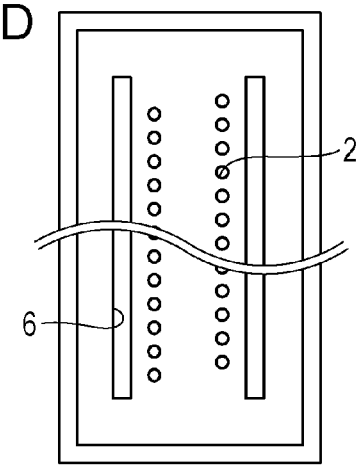
Figure 9B:
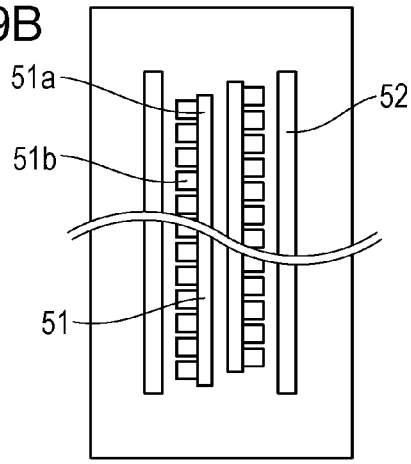

Next, as illustrated in FIGS. 8B and 9B, a soluble resin layer including ink passage patterns (patterns to be ink passages) 51 and groove patterns (patterns to be grooves) 52, serving as bases of the grooves 9, is formed on the surface of the substrate 4 using soluble resin. Each ink passage pattern 51 includes a linear portion 51*a* and a plurality of branch portions 51*b*. The linear portion 51*a* is disposed inside the pair of lines of the energy generating elements 1 so as to extend along the energy generating elements 1. The branch portions 51*b* extend from the linear portion 51*a* so as to overlie the respective energy generating elements 1. The groove patterns 52 are arranged outside the pair of lines, facing each other, of the energy generating elements 1.

For a process of forming the ink passage patterns and the groove patterns 52, photolithography using a photosensitive material is the most typical. To form the ink passage patterns 51 and the groove patterns 52 using a photosensitive material, a soluble positive resist or a solubility-changeable negative resist is used.

Figure 8C:
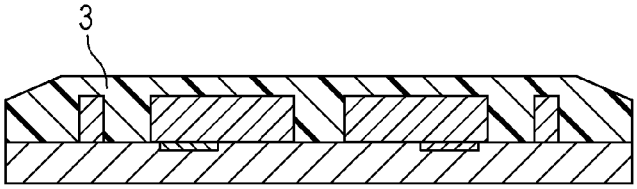
Figure 9E:
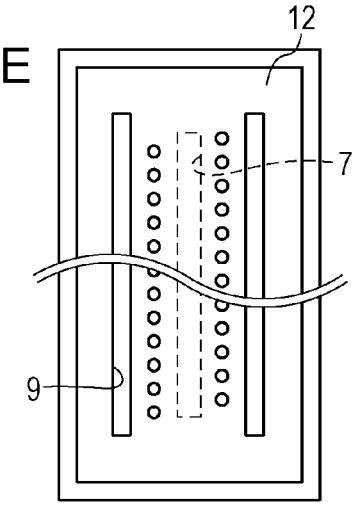
Figure 9C:
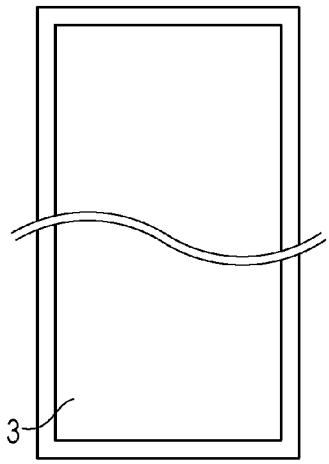

After the ink passage patterns 51 and the groove patterns 52 are formed, the resin coating layer 3 is formed by, for example, spin coating or roll coating, as illustrated in FIGS. 8C and 9C. Spin coating can be used to form the resin coating layer 3 on the ink passage patterns 51 and the groove patterns 52 which are formed of soluble resin. The use of spin coating, as a thin-film coating technique, allows the resin coating layer 3 to be evenly formed with accuracy. Consequently, the distance between each energy generating element 1 and the discharge port surface 12 can be reduced, which has been difficult in the related art. Thus, a small ink droplet of 5 pl or less can be discharged.

If the ink supply port 7 has already been disposed in the substrate 4, a photosensitive material is dissolved by a proper solvent and the dissolved material is applied to a film of polyethylene terephthalate (PET) or the like and is then dried, thus forming a dry film. The dry film is laminated to the substrate 4 to form a resist layer for the ink passage patterns 51. For the dry film, vinyl ketone photodegradable polymeric compounds, such as poly(methyl isopropyl ketone) and poly (vinyl ketone), serving as positive resists, may be used. The reason is that these compounds exhibit properties (coating ability) of a polymeric compound before irradiation with light and can be laminated over the ink supply port 7.

If the ink supply port 7 is filled with a material that can be removed by post-processing, a coating may be formed by a normal method, such as spin coating or roll coating. Instead of photolithography, any other forming method, such as screen printing, may be used.

Since the discharge ports 2 can be accurately formed by photolithography, the resin coating layer 3 may be made of a photosensitive material. The photosensitive material is required to have high mechanical strength for a structural material, adhesiveness to the substrate 4, resistance to ink, and resolution for fine patterning of the discharge ports 2. Examples of the material having the above-described properties include epoxy resin cured by cationic polymerization.

If the central region of the resin coating layer 3 descends toward the substrate 4 and is not flat, the discharge ports 2 would be formed so as to be tilted relative to the substrate 4, thus causing ink to be discharged in unintended directions. The resin coating layer 3 may be formed such that the distance between the surface of the substrate 4 and the central region of the resin coating layer 3 is constant.

Since the soluble resin layer is disposed on the substrate 4, the ink passage patterns 51 and the groove patterns 52 prevent resin that constitutes the resin coating layer 3 from spreading out. This facilitates flattening of the central region of the discharge port surface 12 of the resin coating layer 3. In the comparative example, a groove pattern 52 is continuously formed along all of the ends of the discharge port surface 12 so as to surround the central region of the discharge port surface 12. This facilitates flattening of not only the central region of the discharge port surface 12 but also the entire discharge port surface 12. On the other hand, in the first embodiment, the groove patterns 52 are formed so as not to reach the regions that are sandwiched between the extension lines of the discharge port lines and each region is disposed between the end of the resin coating layer 3 intersecting the extension lines of the discharge port lines and the ends of the discharge port lines. It is accordingly difficult to flatten the discharge port surface 12 other than the central region of the resin coating layer 3. Specifically, in the vicinity of each end of the substrate 4 in which the soluble resin layer is not formed, the resin constituting the resin coating layer 3 spreads outward on the surface of the substrate 4 under the influence of gravity. Thus, the slope regions 5 are formed in the discharge port surface 12 of the resin coating layer 3.

Subsequently, the resin coating layer 3, formed of the photosensitive material, on the substrate 4 is subjected to pattern exposure. The resin coating layer 3 in this embodiment is formed of a negative photosensitive resin. Portions where the discharge ports 2 are to be formed are accordingly shielded by masks. For the pattern exposure, for example, ultraviolet (UV) rays, deep UV rays, electron beams, or X-rays may be appropriately used depending on the photosensing range of a cationic photopolymerization initiator used. To promote a reaction caused by pattern exposure, the photosensitive resin coating layer 3 may be subjected to heat treatment. Since the epoxy resin cured by cationic polymerization used for the resin coating layer 3 is present in a solid state at room temperature, cationic polymerization initiating species generated by pattern exposure barely diffuse, thus achieving highly accurate patterning and shaping.

As described above, photolithography can be used in each of the step of forming the ink passage patterns 51 and the groove patterns 52 and the step of subjecting the resin coating layer 3 to pattern exposure. Thus, the discharge ports 2 and the ink passages 8 can be formed with more accurate dimensions than those obtained by a process, used in the comparative example, of laminating an orifice plate (discharge port member) to the substrate 4.

Figure 8D:
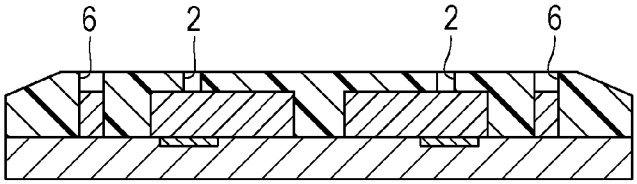

After the resin coating layer 3 is subjected to pattern exposure, the resin coating layer 3 is developed using a solvent, so that the discharge ports 2 and a pair of linear through holes 6 are formed as illustrated in FIGS. 8D and 9D. After that, the discharge port surface 12 is subjected to hydrophilic treatment and the common liquid chamber 11 and the ink supply port 7 are formed in the substrate 4 by anisotropic etching or the like. If the ink supply port 7 has already been disposed, the common liquid chamber 11 is formed in this step. In general, a plurality of resin coating layers 3 having the same shape or different shapes are arranged on the substrate 4. To separate the resin coating layers 3, the substrate 4 is cut. In this case, the ink passage patterns 51 and the groove patterns 52 remain between the resin coating layer 3 and the substrate 4 because these patterns have not yet been dissolved. This prevents dust from entering the ink passages 8 defined by the ink passage patterns 51 and the grooves 9 defined by the groove patterns 52 in the step of cutting the substrate 4.

Figure 8E:
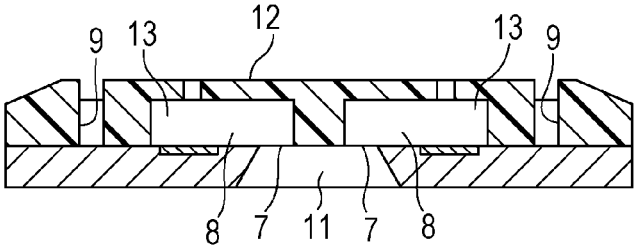

Finally, the soluble resin layer including the ink passage patterns 51 and the groove patterns 52 is dissolved and removed through the discharge ports 2 and the ink supply port 7, thereby forming the ink passages 8 and the grooves 9 as illustrated in FIGS. 8E and 9E. Thus, the liquid discharge head is completed. Since scum (development residues) generated upon development of the photosensitive resin coating layer 3 is dissolved and removed together with the ink passage patterns 51 and the groove patterns 52, the scum is not left in the ink passages 8 and the grooves 9.

The ink passage patterns 51 and the groove patterns 52 may be developed together with the photosensitive resin coating layer 3 which has not yet been subjected to exposure. Additionally, the hydrophilic treatment for the discharge port surface 12 may be performed after the ink passages 8 and the grooves 9 are formed. If the resin coating layer 3 is made of a material having a desired hydrophilic property, the hydrophilic treatment may be omitted.

Furthermore, crosslink density has to be increased in order to increase the adhesiveness of the photosensitive resin coating layer 3 to the substrate 4 and the ink resistance of this layer. To increase the crosslink density, the photosensitive resin coating layer 3 is immersed in a solution containing a reducer and is heated, so that the layer is post-cured. For the reducer, any substance having a reduction action may be used. In particular, compounds containing copper ions, such as copper triflate, copper acetate, and copper benzoate, and ascorbic acid are effective. Among these compounds, copper triflate particularly exhibits a high degree of effectiveness. The step of immersing the resin coating layer 3 in the solution containing such a reducer and heating the layer may be performed after the photosensitive resin coating layer 3 is subjected to pattern exposure and is developed and the discharge ports 2 are thus formed.

The slope regions 5 of the discharge port surface 12 of the liquid discharge head allow an overflow of ink, caused by repeated discharge of ink, in the central region of the discharge port surface 12 where the discharge ports 2 are arrayed to travel toward the portions near the ends of the resin coating layer 3 in which no discharge ports 2 are arrayed. In addition, the grooves 9 are arranged so as not to reach the regions that are sandwiched between the extension lines of the discharge port lines and each region is disposed between the end of the resin coating layer 3 intersecting the extension lines of the discharge port lines and ends of the discharge port lines. Thus, the central region in which the discharge ports 2 are arrayed communicates with the slope regions 5. Consequently, ink which overflows in the central region of the discharge port surface 12 where the discharge ports 2 are arrayed and which is not absorbed by the hydrophilic treatment layer is allowed to travel to the portions near the ends of the resin coating layer 3 in which no discharge ports 2 are arrayed. This prevents accumulation of the ink which has overflowed in the central region of the discharge port surface 12 where the discharge ports 2 are arrayed. Thus, a predetermined volume of ink is discharged in a given direction from each discharge port 2, leading to less or no defective discharge.

Figure 6:
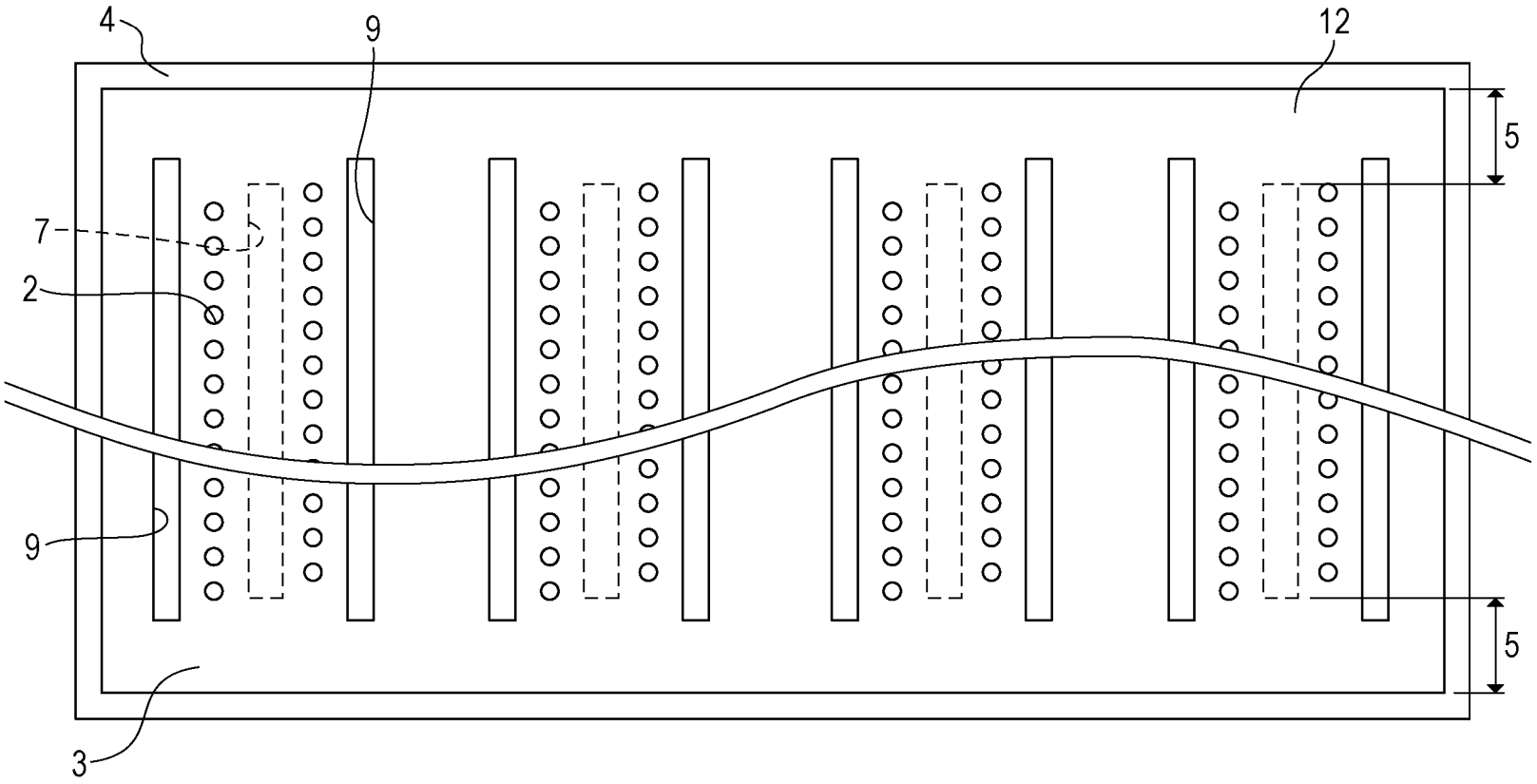
FIG. 6 is a plan view of a liquid discharge head including a plurality of discharge portions according to a second embodiment of the present invention.

In the present invention, one pair of discharge port lines and one pair of grooves 9 sandwiching the pair of discharge port lines therebetween constitute a discharge portion. According to a second embodiment, a plurality of discharge portions are arranged as illustrated in FIG. 6. In the arrangement of the discharge portions, the slope regions 5 are arranged such that each slope region 5 is continuous between the end of the resin coating layer 3 intersecting the extension lines of the discharge port lines and the ends of the discharge port lines. In the liquid discharge head including the discharge portions, since each pair of grooves 9 are arranged so as to sandwich the pair of discharge port lines, the grooves 9 inhibit an overflow of ink in the vicinity of the discharge port lines in the discharge port surface 12 from flowing to the next pair of discharge port lines. This prevents different colors of ink from mixing one another on the discharge port surface 12.

Figure 7A:
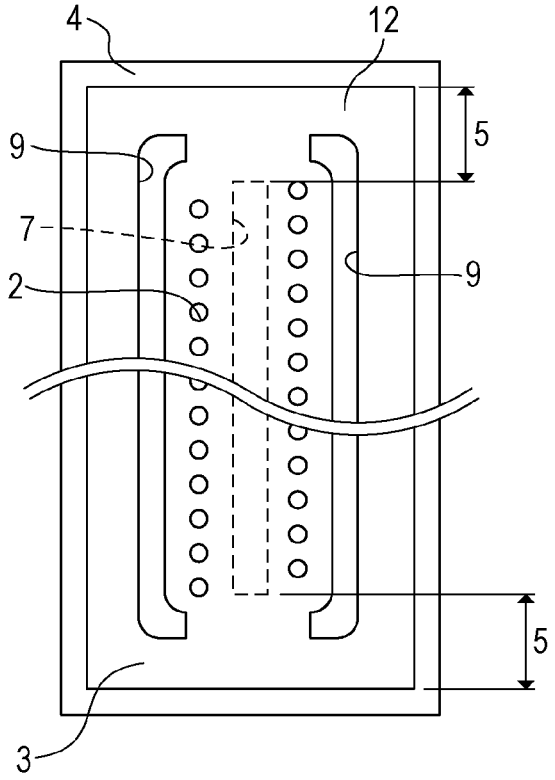
FIGS. 7A and 7B are plan views of liquid discharge heads according to modifications of the first embodiment of FIG. 1.
Figure 7B:
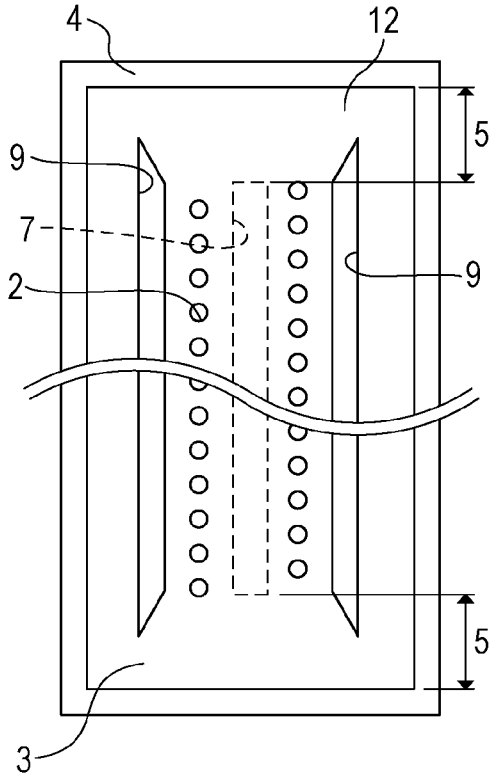

Furthermore, the shape of each groove 9 is not limited to a straight line. As illustrated in FIG. 7A, the groove 9 may include bending portions in a longitudinal direction of the discharge port line such that each bending portion is disposed between the end of the resin coating layer 3 intersecting the extension lines of the discharge port lines and the end of the discharge port line. In this case, the groove 9 is disposed so as not to reach the extension line of the discharge port line. The groove 9 may have tapered ends that decrease in thickness as illustrated in FIG. 7B. In this case, the surface area of each slope region 5 increases, thus facilitating travel of an overflow of ink on the discharge port surface 12 to the portions near the ends of the resin coating layer 3 where no discharge ports 2 are arrayed.

EXAMPLE

Solid printing was successively performed on A4 sheets at a duty cycle of 25% using the liquid discharge head according to the first embodiment illustrated in FIG. 1A and the liquid discharge head according to the comparative example illustrated in FIG. 5A. After a while from the start of solid printing, a white streak appeared at the beginning of an image printed by the liquid discharge head according to the comparative example. On the other hand, the solid printing on A4 sheets by the liquid discharge head according to the first embodiment was completed without any white streak. After the printing, the discharge port surfaces 12 of the respective liquid discharge heads were observed. In the liquid discharge head according to the comparative example, a large volume of ink accumulated on the discharge port surface 12 surrounded by the groove 9. In the liquid discharge head according to the first embodiment, the volume of ink accumulated in the central region, including the array of the discharge ports 2, of the discharge port surface 12 was less than that in the comparative example.

As described above, if the liquid discharge head according to the first embodiment repeatedly discharges ink, an overflow of ink does not tend to accumulate in the central region, where the discharge ports 2 are arrayed, of the discharge port surface 12.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-085692, filed Apr. 16, 2013, which is hereby incorporated by reference herein in its entirety.

What is claimed is:

1. A liquid discharge head comprising:

a substrate including an energy generating element that generates energy used to discharge liquid; and a discharge port member having a discharge port surface with a discharge port line including discharge ports through which the liquid is discharged, the discharge ports being arrayed in a first direction, wherein the discharge port surface includes a groove portion disposed between the discharge port line and a first end of the discharge port member extending in a second direction intersecting the first direction, the groove portion extending along the discharge port line, and an inclined surface disposed between an end of the discharge port line and a second end of the discharge port member extending in the first direction, the inclined surface being inclined toward the second end.

2. The liquid discharge head according to claim 1, wherein a static contact angle of pure water on the discharge port surface is less than or equal to 30°.

3. The liquid discharge head according to claim 1, wherein the inclined surface has no groove portion.

* * * * *